US012736260B2

(12) United States Patent
Borrowman et al.

(10) Patent No.: US 12,736,260 B2
(45) Date of Patent: Sep. 15, 2026

(54) REFRIGERATION SYSTEM WITH HEAT PUMP COMPRESSION

(71) Applicant: TOROMONT INDUSTRIES LTD., Concord (CA)

(72) Inventors: Wayne Borrowman, Scarborough (CA); David Fauser, Toronto (CA)

(73) Assignee: TOROMONT INDUSTRIES LTD., Concord (CA)

( * ) Notice: Subject to any disclaimer, the term of this patent is extended or adjusted under 35 U.S.C. 154(b) by 354 days.

(21) Appl. No.: 18/348,819

(22) Filed: Jul. 7, 2023

(65) Prior Publication Data

US 2024/0011690 A1 Jan. 11, 2024

Related U.S. Application Data

(60) Provisional application No. 63/359,324, filed on Jul. 8, 2022.

(51) Int. Cl.
*F25B 13/00* (2006.01)
*F25B 31/02* (2006.01)
*F25B 49/02* (2006.01)

(52) U.S. Cl.
CPC ..... *F25B 49/022* (2013.01); *F25B 13/00* (2013.01); *F25B 31/02* (2013.01)

(58) Field of Classification Search
CPC ..... F25B 49/022; F25B 13/00; F25B 31/02
See application file for complete search history.

(56) References Cited

U.S. PATENT DOCUMENTS

2009/0120108 A1* 5/2009 Heinbokel ..... F25B 29/003 62/115
2013/0340455 A1* 12/2013 Martin ..... F25B 41/20 62/126

* cited by examiner

*Primary Examiner* — Nael N Babaa
(74) *Attorney, Agent, or Firm* — NORTON ROSE FULBRIGHT CANADA LLP

(57) ABSTRACT

A refrigeration system may have a main refrigeration circuit including at least a first compression stage, a first refrigerant cooling stage, and an evaporation stage, a refrigerant circulating between the first compression stage, the first refrigerant cooling stage and the evaporation stage in a refrigeration cycle. A heat pump compression system may be in fluid communication with the main refrigeration circuit, the heat pump compression system including a second compression stage and a second refrigerant cooling stage in which said refrigerant circulates. A controller unit may be configured for operating the refrigeration system such that the heat pump compression system has a reclaim mode in which heat is reclaimed in the second cooling stage at a higher temperature than in the first cooling stage, and a cooling mode in which the first compression stage and the second compression stage operate concurrently to meet a cooling load of the evaporation stage.

20 Claims, 4 Drawing Sheets

REFRIGERATION SYSTEM WITH HEAT PUMP COMPRESSION

CROSS-REFERENCE TO RELATED APPLICATION

The present application claims the benefit of U.S. Patent Application No. 63/359,324, filed on Jul. 8, 2023 and incorporated herein by reference.

FIELD OF THE APPLICATION

The present application relates to refrigeration systems used in industrial refrigeration applications and to efficient uses thereof.

BACKGROUND OF THE ART

Industrial-size refrigeration systems are used in numerous applications. For example, supermarkets, large-scale buildings, sporting facilities, industrial cooling facilities are among the numerous instances in which central refrigeration systems are used. The central refrigeration systems may be used for refrigerating foodstuff, for air-conditioning space, for operating freezers, and/or for maintaining ice-playing surfaces (also known as ice sheets), with some of these functionalities combined when required by the facilities.

In such industrial-size refrigeration systems, compressor capacity is selected as a function of the evaporative load. For example, compressor capacity for an ice rink refrigeration system is selected so as to produce and maintain ice sheets for the warmest summer days. As a result, compressor capacity may be sized to satisfy maximum evaporative load in spite of the infrequent occurrence of such cooling demand. Thus, it could be said that compressor capacity is oversized for most of the year, or most of the uses.

Moreover, as global climate concerns have driven requirements for more efficient energy consumption, refrigeration systems may be regarded as being inefficient due to the amount of heat that is exhausted to the environment, while fossil fuels may be used in parallel to the heat rejection, in some facilities, to generate heat for other applications. Stated differently, heat may not be optimally reclaimed in some industrial-size refrigeration systems. As an example, in the winter months when compressors operate at low tonnage, it may be required to burn fuel/gas for heating needs of a given facility.

SUMMARY OF THE APPLICATION

It is therefore an aim of the present disclosure to provide a refrigeration system that addresses issues associated with the prior art.

In a first aspect, there is provided a refrigeration system comprising: a main refrigeration circuit including at least a first compression stage, a first refrigerant cooling stage, and an evaporation stage, a refrigerant circulating between the first compression stage, the first refrigerant cooling stage and the evaporation stage in a refrigeration cycle; a heat pump compression system in fluid communication with the main refrigeration circuit, the heat pump compression system including a second compression stage and a second refrigerant cooling stage in which said refrigerant circulates; and a controller unit configured for operating the refrigeration system such that the heat pump compression system has a reclaim mode in which heat is reclaimed in the second cooling stage at a higher temperature than in the first cooling stage, and a cooling mode in which the first compression stage and the second compression stage operate concurrently to meet a cooling load of the evaporation stage.

In a second aspect, there is provided a system for operating a refrigeration system, comprising: a processing unit; and a non-transitory computer-readable memory communicatively coupled to the processing unit and comprising computer-readable program instructions executable by the processing unit for: operating a main refrigeration circuit as a function of a cooling load of an evaporation stage; when a heat reclaim capacity of the main refrigeration is below a given reclaim threshold, directing refrigerant from a compressor discharge of the main refrigeration circuit to a heat pump compression system to generate additional heat for reclaim; and when a cooling capacity of the main refrigeration circuit is below a given cooling threshold, directing refrigerant from a compressor suction of the main refrigeration circuit to the heat pump compression system to generate additional cooling.

In a third aspect, there is provided a system for operating a refrigeration system, comprising: a processing unit; and a non-transitory computer-readable memory communicatively coupled to the processing unit and comprising computer-readable program instructions executable by the processing unit for: operating a main refrigeration circuit as a function of a cooling load of an evaporation stage; and operating a heat pump compression system in parallel to the main refrigeration circuit as a heat pump having a high-grade heat reclaim mode to generate high-grade heat as a function of a heating demand, and a supplemental cooling mode to generate additional cooling to satisfy the cooling load of the evaporation stage.

DESCRIPTION OF THE PREFERRED EMBODIMENTS

Figure 1:
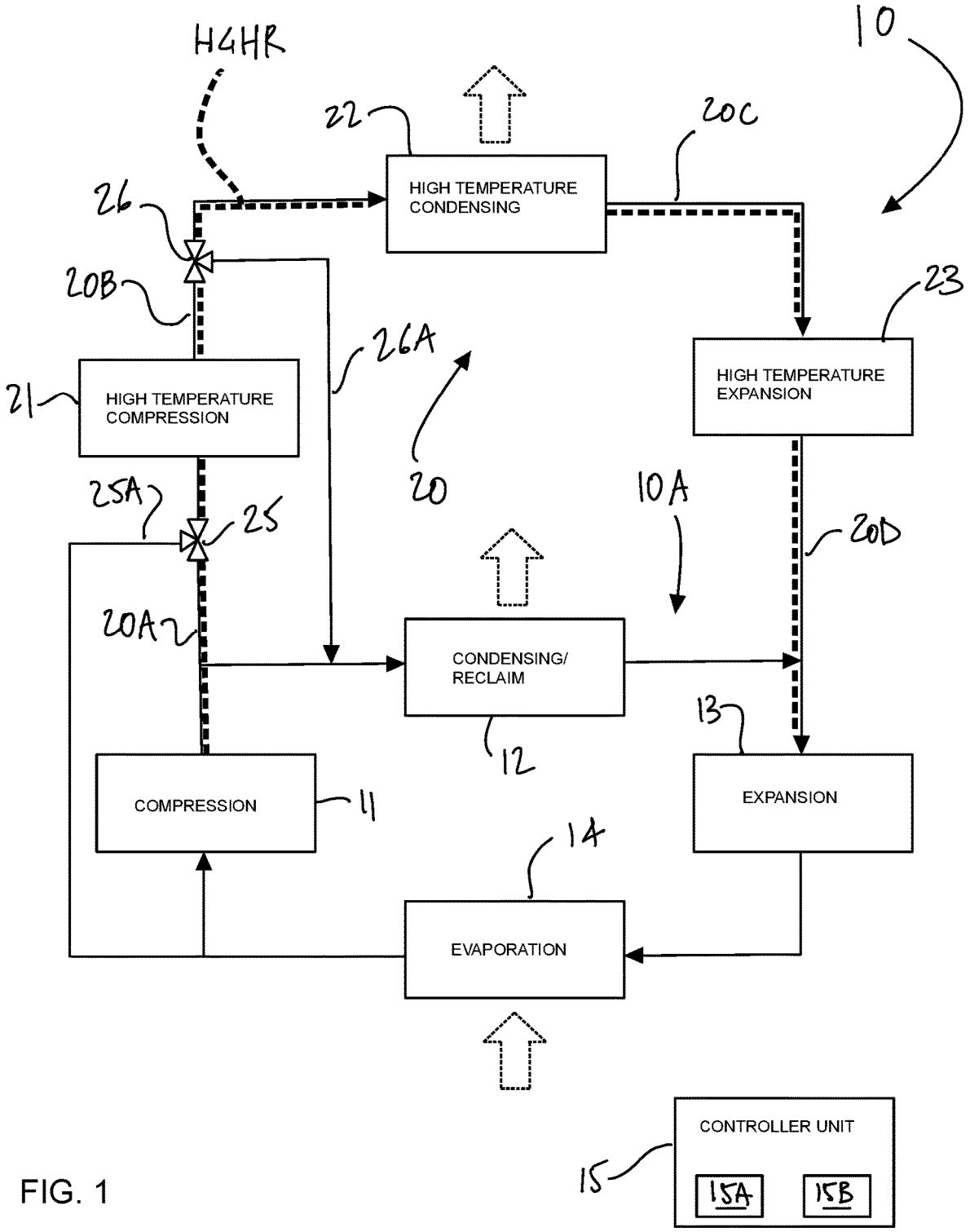
FIG. 1 is a block diagram of a refrigeration system with heat pump compression in accordance with the present disclosure, in high-grade heat reclaim mode.

Referring to FIG. 1, a refrigeration system with heat pump compression system in accordance with the present disclosure is illustrated at 10, and is provided as an example. The refrigeration system 10 may have a conventional refrigeration circuit (referred to as main refrigeration circuit and shown as 10A for reference purposes) featuring a compression stage 11, a condensing stage 12, an expansion stage 13 and/or an evaporation stage 14.

Refrigerant enters compressor(s) in the compression stage 11 as a saturated vapor (or other condition) and is compressed to a higher pressure and temperature. In a variant, the compression stage 11 has numerous compressors in parallel and/or cascaded, the compression stage 11 representative as a box of a plurality of compressors as a possibility. The compressed refrigerant vapor is then routed to the condensing stage 12 where it is cooled and condensed into a liquid by flowing through a condenser unit(s), in which the refrigerant circulates through coils with a coolant such as cooling water or cooling air flowing across the coils, whereby the circulating refrigerant rejects heat from the refrigeration system, the rejected heat is carried away by either the liquid (e.g., water, glycol) or the air (or like gas coolant) depending on the type of condenser unit used, as described below.

In essence, a condenser unit is where a vapor refrigerant is condensed into a liquid refrigerant. Depending on the type of refrigerant and the pressures, it is also possible that the vapor refrigerant remains at least partially in a vapor condition, and this may be known as gas cooling. Such gas cooling may also be part of the condensing stage 12 even if condensation does not occur or occurs in a minimum fashion.

The condensing stage 12 may also include heat reclaim. Different types of condenser units may be used as part of the condensing stage 12, with one or more condenser unit in the refrigeration system 10, such as air-cooled condenser units, gas coolers, evaporative condenser units, and water-cooled condenser units. The condensation stage 12 is shown generally, but may have different components in different arrangements, such as heat exchangers used in heat reclaim, in parallel and/or in series with condenser units that reject heat to the environment. The condensing stage 12 may thus also be referred to as a cooling stage or heat release stage as heat is released from the refrigerant through stage 12.

The condensing liquid refrigerant may then be accumulated in one or more receivers (not shown). The receiver(s) is one or more storage vessels (i.e., tank, reservoir) in which the refrigerant is stored mostly in a liquid state, with vapour. The condensed liquid refrigerant may next be directed through an expansion stage 13 in which valve(s) of any type, such as expansion valves, causes a reduction in pressure to the refrigerant. Other mechanisms and configurations may also be used, including flooded configurations with a pump or pumps, such that the expansion stage 13 may be optional. The pressure reduction results in a lowering of the temperature of the refrigerant to reach a temperature colder than the temperature of the fluid, space and/or surface to be refrigerated. The colder refrigerant is then circulated in the coil or tubes of evaporator(s) of the evaporation stage 14, by which the cold refrigerant absorbs heat from a fluid, such as a liquid or a gas depending on the application with which the refrigeration system 10 is used. The evaporation stage 14 is where the refrigerant absorbs and removes heat that is subsequently rejected in the condensing stage 12. The coils of the evaporation stage 14 may be part of refrigerated enclosures, such as in a supermarket, in a slab of an ice sheet, in industrial refrigeration coils, etc, all this depending on the contemplated use. As another possibility, the coils of the evaporation stage 14 are part of a heat exchanger, with the refrigerant of the refrigeration system 10 being in heat exchange with a coolant (e.g., glycol, brine). In an embodiment, the coolant circulates in coils of an ice sheet. Other arrangements are considered as well, depending on the contemplated use of the refrigeration system 10.

To complete the refrigeration cycle, the vapor resulting from the evaporation stage 14 is again at least partially in a saturated vapor state and is cycled into the compression stage 11. Depending on the application, a desuperheater may be present to ensure that gas is fed to the compression stage 11. The circuit portion of the refrigeration system 10 between the compression stage 11 and the expansion stage 13 (including the condensing stage 12 and receiver(s) 13) may be referred to as the high-pressure side as the refrigerant pressure is higher in comparison to a circuit portion of the refrigeration system 10 between the expansion stage 13 and the compression stage 11 (including the evaporation stage 14), itself referred to as the low-pressure side. The demarcation between high-pressure side and low-pressure side may be elsewhere, such as at a pressure regulating valve for transcritical refrigeration or for other purposes, upstream of the expansion stage 13.

The refrigeration system 10 is schematically shown in FIG. 1 as a simplified example of a system capable of operating a refrigeration cycle. However, multiple other features and components may be added to the refrigeration system 10, such as a desuperheater upstream or as part of condensing/rejection stage 12, defrosting, heat reclaiming, receivers, oil systems, to name but a few, as well as the appropriate piping and valves to ensure that the refrigerant is directly to the various components as desired. Again, the refrigeration system 10 may include a plurality of compressors (e.g., in parallel, cascaded, dedicated), condensers, evaporators, depending on the refrigeration load of the system 10. Moreover, different types of refrigerant may be used, including synthetic fluorocarbon refrigerants and their blends (e.g., HCFC, HFC, HFO and blends thereof), ammonia, $CO_2$ refrigerant, hydrocarbon refrigerant, etc, for different uses, such as industrial refrigeration (e.g., process refrigeration, industrial cold storage), ice-playing surfaces (a.k.a., ice sheets), supermarket refrigeration, HVAC, among possibilities.

A controller unit 15 may be used to centrally control the various components and stages of the refrigeration system 10. The controller unit 15 is the processing unit of the refrigeration system 10, and may have one or more processors 15A. A non-transitory computer-readable memory 15B may be communicatively coupled to the processing unit and may have computer-readable program instructions executable by the processing unit for operating a transfer cycle described herein.

The controller unit 15 has a processor with user interfaces, and may receive data from various sensors located at different locations in the refrigeration system 10 and in the environment of the refrigeration system 10, e.g., temperature and pressure sensors, etc. The controller unit 15 may also communicate with the components of the refrigeration system 10, to turn them on and off, and to adjust their operating parameters. This may include the operation of valves (e.g., solenoid valves) located throughout the refrigeration system 10. The controller unit 15 may also be in communication with user applications that can seek operator guidance remotely. For example, a user device may be in wireless communication with the controller unit 15, for instance by cellular network and/or internet, etc. Although not shown, the controller unit 15 receives operational data from various sensors in the refrigeration system 10, or associated with the refrigeration system 10, such as indoor and outdoor temperature sensors (e.g., thermometers, thermocouples).

Still referring to FIG. 1, the refrigeration system 10 includes a heat pump compression system 20 in fluid communication with the main refrigeration circuit 10A described above, in selected circumstances. The expressions "heat pump circuit", "heat pump compression circuit", "heat pump loop", "heat pump circuit portion", etc may also be used to describe the heat pump compression system 20. The heat pump compression system 20 may be said to be a permanent part of the refrigeration facility as tied to the refrigeration system 10. The heat pump compression system 20 may also be said to be part of the refrigeration system 10, and its operation may be controlled by the controller unit 15.

The heat pump compression system 20 may have a compressor or compressors 21 (both options encompassed by the block shown in FIG. 1), a high-temperature condenser or like condensing stage 22 and an expansion stage 23. The compressor 21, the condensing stage 22 and the expansion stage 23 are sequentially connected by one or more lines, respectively illustrated as 20A, 20B, 20C and 20D. The expression "line" refers to piping, pipes, conduits, and components thereon, that form a passage for refrigerant.

As observed, when going through the heat pump compression system 20, at least a portion of the refrigerant from a discharge of the compression stage 11 may be routed to the high-temperature compression stage 21. Refrigerant compressed in the compression stage 21 may then be directed to the condensing stage 22 via line 20B. The condensing stage 22 may also be known or be operated as a gas cooling stage, or in any other way to release heat. Thereafter, refrigerant having heat removed from it in the stage 22 (e.g., condensing stage 22) reaches the high-temperature expansion stage 23 via line 200. Finally, refrigerant is then returned to the main refrigeration circuit 10A via line 20B. More particularly, the refrigerant converges with the refrigerant exiting the condensing stage 12, as refrigerant at the exit of the compression stage 11 may be divided into the main refrigeration circuit 10A and the heat pump compression system 20. The heat pump compression system 20 may further include a valve 25. In a variant, valve 25 may be a three-way valve that is in line 20A and that may also receive refrigerant via line 25A that is coupled to or part of a suction of the main refrigeration circuit 10A, i.e. the piping between the evaporation stage 14 and the compression stage 11. Other types of valves may be present, and examples thereof are provided hereinafter. Thus the compression stage 21 may be in parallel (via line 25A) and/or in series with the compression stage 11.

The controller unit 15 is configured to operate the refrigeration system 10 in a standard mode of operation of the main refrigeration circuit 10A. The standard mode of operation has the sequence of the compression stage 11, the condensing/reclaim stage 12 (or equivalent), the expansion stage 13 (or equivalent) and the evaporation stage 14, as explained above. For simplicity, the operation of the refrigeration system 10 as controlled by the controller unit 15 is explained with respect to the use of such a refrigeration system to refrigerate one or more ice sheets in an arena or like skating facility. However, similar principles of operation may be applied to other of types of facilities, such as industrial refrigeration systems, supermarkets, etc.

During operation of the main refrigeration circuit 10A, refrigerant or coolant is fed to the evaporation stage 14 so as to capture heat of the ice sheet. Stated differently, the main refrigeration circuit 10A is operated to meet the cooling load, the cooling load being the amount of energy required to keep the ice sheet(s) at a desired condition. Heat reclaim may occur in the condensing/reclaim stage 12. However, in some given operation conditions, such as in winter time, the cooling load may be smaller than in summer operation, for different reasons.

For example, if the outdoor temperature is colder, the cooling load may be smaller due to the fact that less heat is lost by the ice sheet (or like refrigeration load) to ambient. Accordingly, the reclaim that may occur in the condensing/reclaiming stage 12 may be qualified as low-grade heat. Depending on the refrigerant, low-grade heat may be defined as condensing refrigerant at the condensing/reclaiming stage 12 being at a typical temperature ranging from 15-40 degrees Celsius, though the temperature range of low-grade heat could be different. This low-grade heat may not be sufficient for some heating loads, such as heating a facility, heating water. For example, in the case of a skating facility, the demand for hot water may be large, notably because of restrooms that require hot water, such as for showers. The reclaim contribution of the desuperheating and condensing/reclaim stage 12 may be insufficient to raise the water temperature sufficiently for restrooms/showers. Therefore, in such scenarios, other sources of heat may be used in order to heat up water, including natural gas or other combustible fuels.

Figure 2:
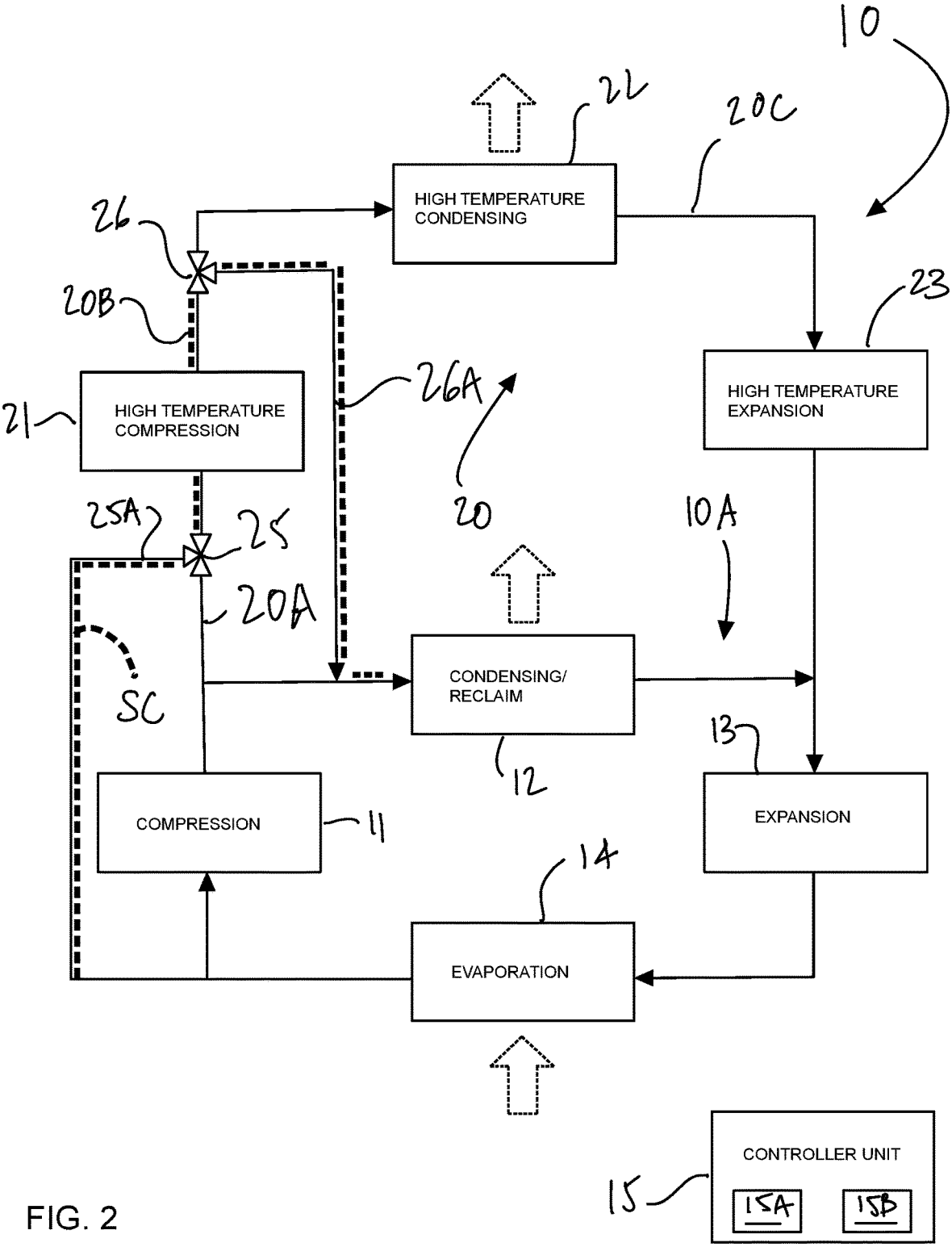
FIG. 2 is a block diagram of the refrigeration system with heat pump compression of FIG. 1, in supplemental cooling mode.

The refrigeration system 10 of FIGS. 1 and 2 is configured to generate high-grade heat, namely heat that is at a typical temperature ranging from 50 to 80 degrees Celsius (though the temperature range of high-grade heat could be different), or a temperature of at least 50 degrees Celsius, and hence contribute to substantially meeting a given heating load, regardless of the cooling load. The controller unit 15 is therefore configured to monitor the operation of the refrigeration system 10 and that of a heating load demand, and trigger a high-grade heat reclaim mode when necessary. In such high-grade heat reclaim mode, shown as HGHR in FIG. 1, at least some of the refrigerant exiting the compression stage 11 in the main refrigeration circuit 10A is routed to the heat pump compression system 20. Refrigerant may be directed to the heat pump compression system 20 via line 20A toward the high-temperature compression stage 21, with valve 25 being open to allow such refrigerant to circulate. While the compression stage 21 is shown as separated from the compression stage 11, the compressors of the stages 11 and 21 may be in a common stack, skid, rack, for instance in a same mechanical room, with a pipe network corresponding to that shown in the present figures, in terms of connection arrangement (and not in terms of length).

In the HGHR mode, line 25A is closed. As the refrigerant fed to the high-temperature compression stage 21 is at the exit of the compression stage 11, it has already been compressed at a relatively high pressure, suitable to meet the cooling load of the evaporation stage 14. The portion of refrigerant directed to the HGHR mode is thus further compressed when entering the heat pump compression system 20 and is routed to the high-temperature condensing stage 22, which condensing stage 22 may essentially operate as a heat reclaim stage. For example, in the condensing stage 22, coils may be present by which a coolant or water is heated. In a variant, the condensation stage 22 includes water heaters. Another variant may include a desuperheater upstream or as part of condensation stage 22, for heat reclaim. Any other reclaim configuration may also be present in the condensation stage 22, depending on the nature of the heating load. Due to the fact that the temperature of the refrigerant exiting the compression stage 21 is at a higher level than that exiting the compression stage 11, because of the cascaded arrangement shown (i.e., serial arrangement), the refrigerant may provide high-grade heat that may be suited to satisfy the heating load, while the heat that is reclaimed from the condensing/reclaim stage 12 cannot, which heat reclaimed in the condensing/reclaim stage 12 is as a function of the refrigeration load. In an embodiment, the high-grade heat generated by the heat pump compression system 20 is sufficient to meet the heating load of the facility, or at least contribute to lessening the consumption of combustion fuels. The cascaded arrangement between the compression stage 11 and the compression stage 21 is one possible way to achieve the HGHR mode. In another arrangement, the compression stage 21 has one or more compressors having a greater compression capacity. In another arrangement, the compression stage 21 has compressors in a cascaded configuration with themselves, i.e., not with compressors of the compression stage 11.

At the exit of the high-temperature condensing stage 22, with high-grade heat having been reclaimed, the refrigerant is to be returned to the main refrigeration circuit 10A. However, its pressure may be too high to return to the main refrigeration circuit 10A. Therefore, line 20C directs the refrigerant to a high-temperature expansion stage 23 that may, for example, have one or more expansion valves to reduce the pressure of the refrigerant, such that the refrigerant directed to the main refrigeration circuit 10A via line 20D is at a suitable pressure to be reinjected in the main refrigeration circuit 10A. other arrangements are possible, such as directing the refrigerant from the heat pump compression system 20 to the condensing/reclaiming stage 12.

Consequently, the heat pump compression system 20 is used in a heat-pump mode to generate heat, even if such a mode is operated in winter conditions that reduce the cooling load. Such mode of operation may reduce the carbon footprint of the refrigeration system 10, depending on the source of electricity, the types of energy used to meet the heating load, and/or the efficiency of equipments, among other factors. It may be indeed more suitable to generate heat using the heat-pump mode if the electricity comes from environmentally friendly sources, such as hydro dams, wind turbines, etc.

The controller unit 15 may also operate a supplemental cooling mode, shown as SC in FIG. 2. In the supplemental cooling mode SC, the heat pump compression system 20 is used to provide additional compression to meet the cooling load of the evaporation stage 14, for example if the compression stage 11 cannot satisfy the cooling load of the evaporation stage 14. The supplemental cooling mode SC is typically operated in warmer days of the year in which the refrigeration demand of the evaporation stage 14 is at its peak, such as during hot summer days. For the controller unit 15 to implement the supplemental cooling mode SC, valve 25 is controlled for refrigerant to be directed from the outlet of the evaporation stage 14 to the compressor stage 21 of the heat pump compression system 20. In a variant, a portion of the refrigerant exiting the evaporation stage 14 is directed toward the compression stage 21, while a remainder of the refrigerant takes the route of the main refrigeration circuit 10A and passes through the compression stage 11. Thus, the compressors of the compression stage 11 and of the compression stage 12 may be said to be in parallel. At the outlet or discharge of the compression stage 21, valve 26 is operated to return the refrigerant to the main refrigeration circuit 10A via line 26A. The refrigeration is direct to the condensing/reclaim line, i.e. upstream of the condensing/reclaim stage 11. Accordingly, in the supplemental cooling mode SC, the high temperature compression stage 21 is used to increase the capacity of the system in working refrigerant to satisfy the cooling load of the evaporation stage 14 (a.k.a., refrigeration load). In a variant, the refrigerant exiting the compression stage 21 may release its heat in the condensing stage 22, though it may not generate high-grade heat.

Therefore, the controller unit 15 uses the heat pump compression system 20 as a heat pump, in that the heat pump compression system 20 is controlled as a function of either a cooling load or a heating load, while the refrigeration system 10 may be used continuously as a function of the cooling load of the facility. When used in the supplemental cooling mode SC, the heat pump compression system 20 increases the cooling capacity of the refrigeration system 10. When used in the high-grade heat reclaim mode HGHR, the heat pump compression system 20 increases the heating capacity of the refrigeration system 10, while not affecting the cooling capacity, to improve energy consumption of the facility. Other modes of operation are considered as well.

Figure 3:
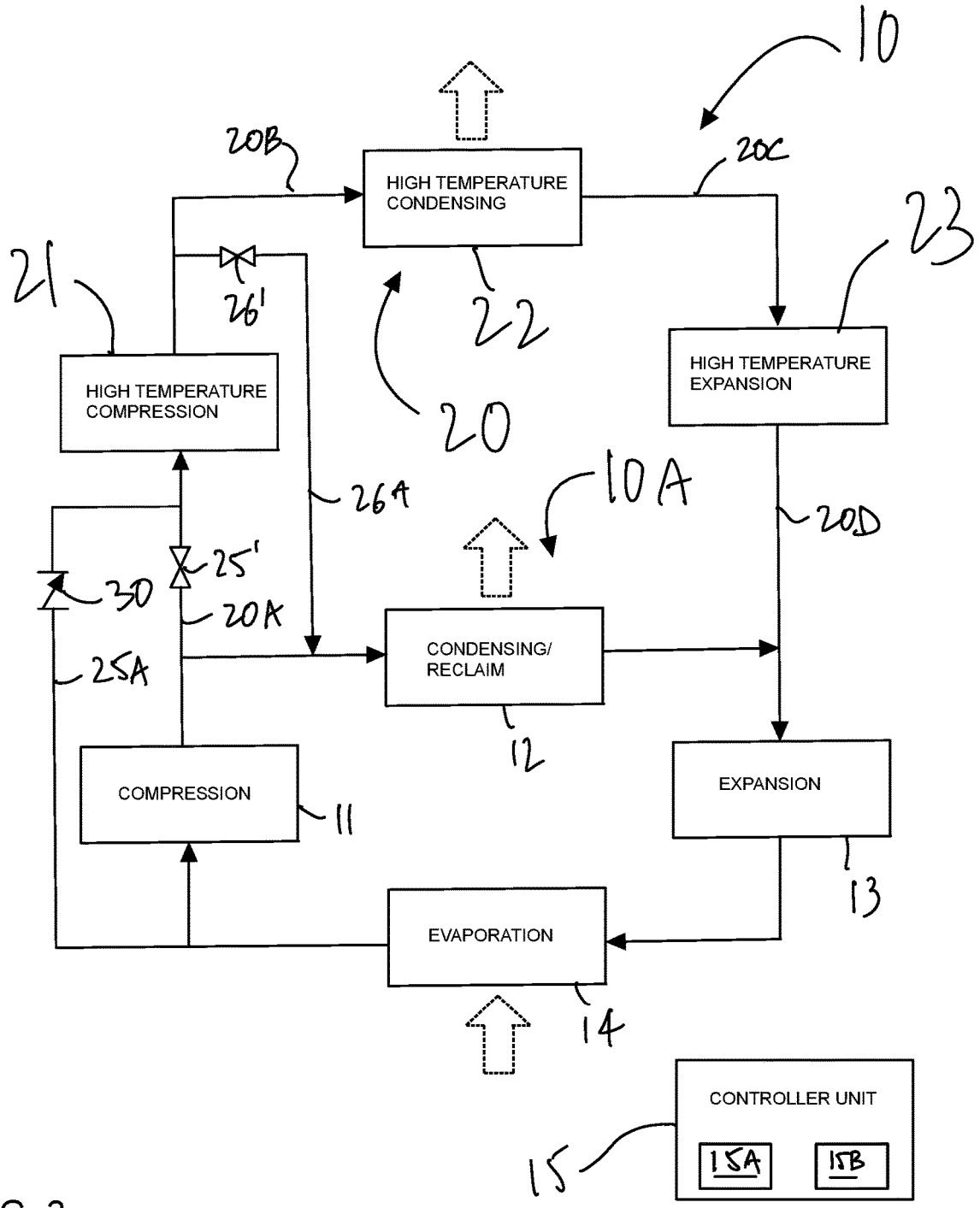
FIG. 3 is a block diagram of another configuration of a refrigeration system with heat pump compression in accordance with the present disclosure.

Referring to FIG. 3, another configuration of a refrigeration system with heat pump compression is also shown as 10, and differs from the refrigeration system 10 of FIGS. 1 and 2 by a different set of valves and piping network. More particularly, instead of having three-way valves 25 and 26 as in the system 10 of FIGS. 1 and 2, two-way valves 25' and 26' are used, along with a unidirectional flow mechanism 30, also known as a check valve. In similar fashion to the refrigeration systems of FIGS. 1 and 2, valve 25' is open in the high-grade heat reclaim mode HGHR, while valve 26' is closed. Accordingly, refrigerant may follow the HGHR path shown in FIG. 1. The unidirectional flow mechanism 30 prevents flowback of refrigerant in line 25A, and the discharge pressure downstream of valve 25' blocks refrigerant passage through the unidirectional flow mechanism 30. The controller unit 15 may be connected to the valves 25' and 26' to operate same.

In the supplemental cooling mode SC, valve 25' is closed while valve 26' is open. Accordingly, refrigerant may follow the SC path shown in FIG. 2. The unidirectional flow mechanism 30 allows refrigerant to pass therethrough.

Figure 4:
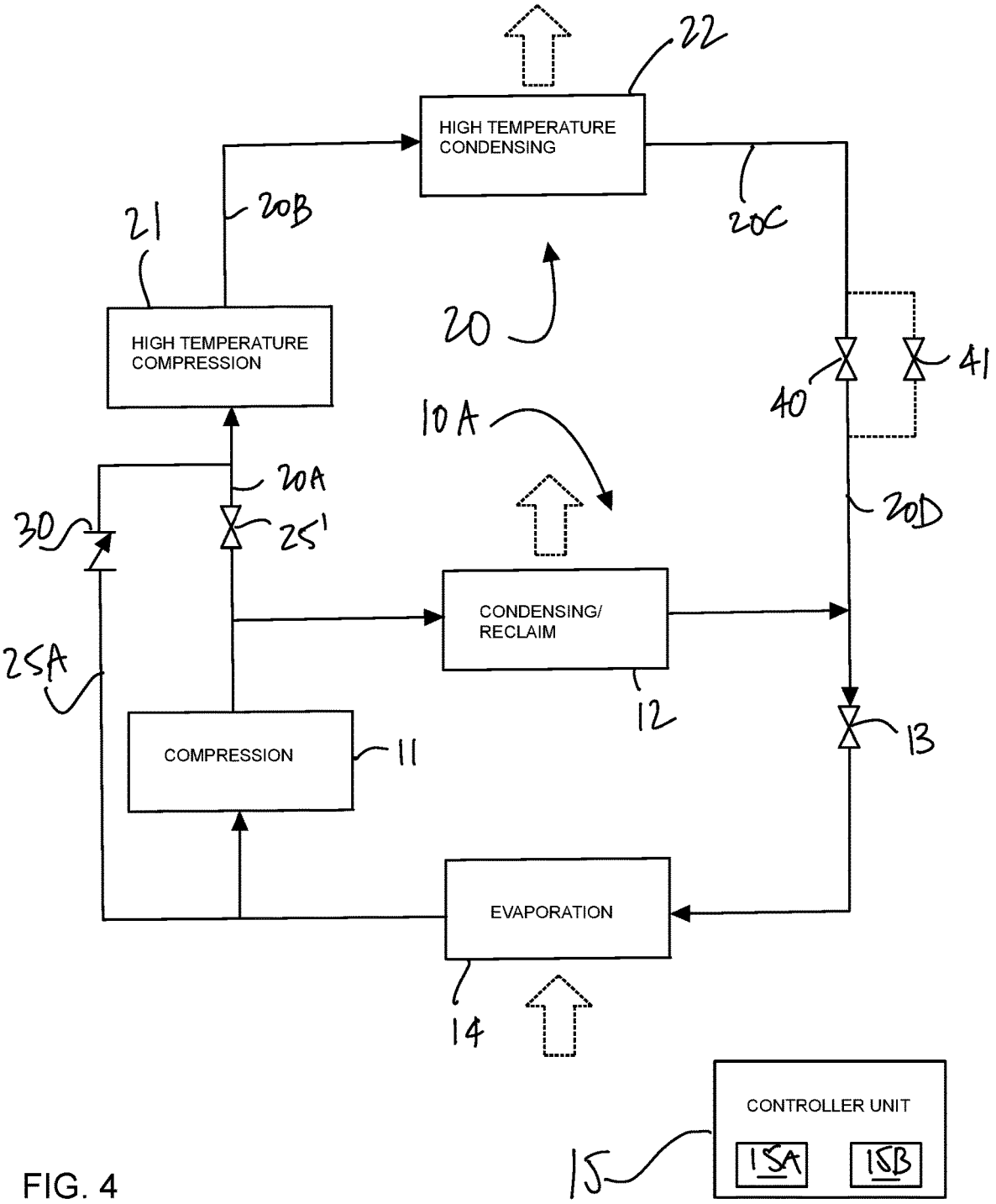
FIG. 4 is a block diagram of yet another configuration of a refrigeration system with heat pump compression in accordance with the present disclosure.

Referring now to FIG. 4, another embodiment is shown for a configuration of a refrigeration system with heat pump compression. In the system shown, a valve 40 is used instead of the high-temperature expansion valves 24. A bypass circuit 41 with valve may also be present. Moreover, in the refrigeration system 10 in FIG. 4, there is no line 26A. In the HGHR mode, the valve 40 maintains a pressure differential while draining liquid, with a receiver present for example. Valve 25' must be opened to allow refrigerant from the discharge of the compression stage 11 to reach the compression stage 21. In the supplemental cooling mode SC, valve 25' is closed, while valve 40 is fully opened or bypassed by the circuit 41. In the refrigeration system 10 of FIG. 4, it can be observed that the condensing stage 22 is active in both HGHR and SC modes. In the HGHR mode, the condensing stage 22 operates at a higher temperature and pressure, to generate high-grade heat, while in the supplemental cooling mode SC, the condensing stage 22 generally operates at the same temperature as the main condensing stage 11, to contribute to meeting the cooling load of the evaporation stage 14.

While the expression "condensing" is used herein and in the figures, the expression "refrigerant cooling" may be appropriately used to described the stages 12 and/or 22, as these stages will result in the cooling of the refrigerant that enters these stages, whether by condensing and/or by gas cooling, whether lost to ambient and/or reclaimed.

In a variant, the refrigeration system 10 may generally be described as having a main refrigeration circuit including at least a first compression stage, a first refrigerant cooling stage, and an evaporation stage, a refrigerant circulating between the first compression stage, the first refrigerant cooling stage and the evaporation stage in a refrigeration cycle; a heat pump compression system in fluid communication with the main refrigeration circuit, the heat pump compression system including a second compression stage and a second refrigerant cooling stage in which said refrigerant circulates; and a controller unit configured for operating the refrigeration system such that the heat pump compression system has a reclaim mode in which heat is reclaimed in the second cooling stage at a higher temperature than in the first cooling stage, and a cooling mode in which the first compression stage and the second compression stage operate concurrently to meet a cooling load of the evaporation stage.

In some variants, the first compression stage has a plurality of compressors; the second compression stage has a plurality of compressors; in the reclaim mode, the second compression stage is serially after the first compression stage for the second compression stage to receive refrigerant from a discharge from the first compression stage; in the reclaim mode, a first portion of the refrigerant discharged from the first compression stage remains in the main refrigeration circuit, and a second portion of the refrigerant discharged from the first compression stage is directed to the heat pump compression system; in the cooling mode, the second compression stage receives refrigerant exiting the evaporation stage; the second refrigerant cooling stage includes at least one heat exchanger by which the refrigerant releases heat to a coolant, such as a liquid coolant; the first refrigerant cooling stage includes at least one heat reclaim heat exchanger; an expansion stage may be downstream of the second refrigerant cooling stage in the heat pump compression system, the heat pump compression system converging with the main refrigeration circuit downstream of the expansion stage; the main refrigeration circuit includes another expansion stage, the other expansion stage between downstream of the converging; the evaporation stage includes an ice sheet heat exchanger; and/or in the heat reclaim mode, the higher temperature is of at least 50 degrees Celsius.

In a variant, the refrigeration system 10 may generally be described as being for operating a refrigeration system, including a processing unit and a non-transitory computer-readable memory communicatively coupled to the processing unit and comprising computer-readable program instructions executable by the processing unit for: operating a main refrigeration circuit as a function of a cooling load of an evaporation stage; when a heat reclaim capacity of the main refrigeration circuit is below a given reclaim threshold, directing refrigerant from a compressor discharge of the main refrigeration circuit to a heat pump compression system to generate additional heat for reclaim; and when a cooling capacity of the main refrigeration circuit is below a given cooling threshold, directing refrigerant from a compressor suction of the main refrigeration circuit to the heat pump compression system to generate additional cooling.

In some variants, directing refrigerant from a compressor suction of the main refrigeration circuit to the heat pump compression system to generate additional cooling occurs on a Summer day; directing refrigerant from a compressor discharge of the main refrigeration circuit to a heat pump compression system to generate additional heat for reclaim occurs on a Winter day; the heat pump compression system may be operated as a heat pump having a high-grade heat reclaim mode to generate high-grade heat as a function of a heating demand, and a supplemental cooling mode to generate said additional cooling to satisfy the cooling load of the evaporation stage; after directing said refrigerant from said compressor discharge to said heat pump compression system to generate additional heat for reclaim, said refrigerant is directed to the main refrigeration circuit via an expansion stage; generating additional heat for reclaim includes generating heat at at least 50 degrees Celsius; operating the main refrigeration circuit as a function of the cooling load of the evaporation stage includes operating the main refrigeration circuit as a function of the cooling load of at least one ice sheet.

It may be said that, in the refrigeration system 10, the refrigeration load (a.k.a., cooling load) is shared by the main refrigeration circuit and the heat pump compression system, i.e., there is one common refrigeration load (with the same refrigerant circulating between the main refrigeration circuit and the heat pump compression system), with the compression stage of the main refrigeration circuit solely operated as a function of meeting the refrigeration load, and the compression stage of the heat pump compression system operated as a heat pump to provide cold for the refrigeration load, or to provide heat for reclaim.

In a variant, the refrigeration system 10 may generally be described as being for operating a refrigeration system, including a processing unit; and a non-transitory computer-readable memory communicatively coupled to the processing unit and comprising computer-readable program instructions executable by the processing unit for: operating a main refrigeration circuit as a function of a cooling load of an evaporation stage; and operating a heat pump compression system in parallel to the main refrigeration circuit as a heat pump having a high-grade heat reclaim mode to generate high-grade heat as a function of a heating demand, and a supplemental cooling mode to generate additional cooling to satisfy the cooling load of the evaporation stage.

Example

As example of a refrigeration system 10 may have a nominal 100 TR (ton of refrigeration) ice rink package would be able to reject 100% of the heat from the main refrigeration circuit 10A at approximately 65 C when the compressor 21 is configured to reject to the high temperature condensing. Alternately when the same compressor 21 is configured to operate in the main refrigeration circuit 10A it could increase the cooling capacity by approximately 20%.

The invention claimed is:

1. A refrigeration system comprising:

a main refrigeration circuit including at least a first compression stage, a first refrigerant cooling stage, and an evaporation stage, a refrigerant circulating between the first compression stage, the first refrigerant cooling stage and the evaporation stage in a refrigeration cycle;

a heat pump compression system in fluid communication with the main refrigeration circuit, the heat pump compression system including a second compression stage and a second refrigerant cooling stage in which said refrigerant circulates; and a controller unit configured for operating the refrigeration system such that the heat pump compression system has a reclaim mode in which heat is reclaimed in the second cooling stage at a higher temperature than in the first cooling stage, and a cooling mode in which the first compression stage and the second compression stage operate concurrently to meet a cooling load of the evaporation stage.

2. The refrigeration system according to claim 1, wherein the first compression stage has a plurality of compressors.

3. The refrigeration system according to claim 1, wherein the second compression stage has a plurality of compressors.

4. The refrigeration system according to claim 1, wherein in the reclaim mode, the second compression stage is serially after the first compression stage for the second compression stage to receive refrigerant from a discharge from the first compression stage.

5. The refrigeration system according to claim 1, wherein in the reclaim mode, a first portion of the refrigerant discharged from the first compression stage remains in the main refrigeration circuit, and a second portion of the refrigerant discharged from the first compression stage is directed to the heat pump compression system.

6. The refrigeration system according to claim 1, wherein in the cooling mode, the second compression stage receives refrigerant exiting the evaporation stage.

7. The refrigeration system according to claim 1, wherein the second refrigerant cooling stage includes at least one heat exchanger by which the refrigerant releases heat to a coolant.

8. The refrigeration system according to claim 7, wherein the coolant is a liquid.

9. The refrigeration system according to claim 1, wherein the first refrigerant cooling stage includes at least one heat reclaim heat exchanger.

10. The refrigeration system according to claim 1, including an expansion stage downstream of the second refrigerant cooling stage in the heat pump compression system, the heat pump compression system converging with the main refrigeration circuit downstream of the expansion stage.

11. The refrigeration system according to claim 10, wherein the main refrigeration circuit includes another expansion stage, the other expansion stage between downstream of the converging.

12. The refrigeration system according to claim 1, wherein the evaporation stage includes an ice sheet heat exchanger.

13. The refrigeration system according to claim 1, wherein in the heat reclaim mode, the higher temperature is of at least 50 degrees Celsius.

14. The refrigeration system according to claim 1, wherein the controller unit includes:

a processing unit; and a non-transitory computer-readable memory communicatively coupled to the processing unit and comprising computer-readable program instructions executable by the processing unit for:

operating the main refrigeration circuit as a function of the cooling load of the evaporation stage;

when a heat reclaim capacity of the main refrigeration circuit is below a given reclaim threshold, directing at least a portion of said refrigerant from a compressor discharge of the main refrigeration circuit to a heat pump compression system to generate additional heat for reclaim; and when a cooling capacity of the main refrigeration circuit is below a given cooling threshold, directing at least a portion of said refrigerant from a compressor suction of the main refrigeration circuit to the heat pump compression system to generate additional cooling.

15. The refrigeration system according to claim 14, wherein directing refrigerant from a compressor suction of the main refrigeration circuit to the heat pump compression system to generate additional cooling occurs on a Summer day.

16. The refrigeration system according to claim 14, wherein directing refrigerant from a compressor discharge of the main refrigeration circuit to a heat pump compression system to generate additional heat for reclaim occurs on a Winter day.

17. The refrigeration system according to claim 14, including operating the heat pump compression system as a heat pump having a high-grade heat reclaim mode to generate high-grade heat as a function of a heating demand, and a supplemental cooling mode to generate said additional cooling to satisfy the cooling load of the evaporation stage.

18. The refrigeration system according to claim 14, wherein, after directing said refrigerant from said compressor discharge to said heat pump compression system to generate additional heat for reclaim, said refrigerant is directed to the main refrigeration circuit via an expansion stage.

19. The refrigeration system according to claim 14, wherein generating additional heat for reclaim includes generating heat at at least 50 degrees Celsius.

20. The refrigeration system according to claim 14, wherein operating the main refrigeration circuit as a function of the cooling load of the evaporation stage includes operating the main refrigeration circuit as a function of the cooling load of at least one ice sheet.

* * * * *